United States Patent [19]

Krishna et al.

[11] Patent Number: 4,964,979

[45] Date of Patent: Oct. 23, 1990

[54] METHOD FOR SUPPRESSING THE DEHYDROGENATION ACTIVITY OF DEPOSITED METALS ON INERT SOLIDS IN HEAVY OIL PRETREATMENT

[76] Inventors: Ashok S. Krishna, 4925 Sunlight Ct., Concord, Calif. 94518; Ramamoorthy Periaswamy, 3732 Morningside Dr., El Sobrante, Calif. 94830

[21] Appl. No.: 391,062

[22] Filed: Aug. 7, 1989

Related U.S. Application Data

[63] Continuation of Ser. No. 106,485, Oct. 6, 1987, abandoned.

[51] Int. Cl.[5] ..... C10G 29/04

[52] U.S. Cl. ..... 208/253; 208/251 R; 208/307

[58] Field of Search ..... 502/821; 208/48 R, 48 AA, 208/251 R, 253, 306, 307

[56] References Cited

U.S. PATENT DOCUMENTS

| | | | |
|---|---|---|---|
| 3,977,963 | 8/1976 | Readal et al. | 208/48 AA |
| 4,178,267 | 12/1979 | McKay | 502/521 |
| 4,193,891 | 3/1980 | McKay | 208/48 AA |
| 4,263,131 | 4/1981 | Bertus et al. | 208/48 AA |
| 4,466,884 | 8/1984 | Occelli et al. | 208/253 |
| 4,489,169 | 12/1984 | Bertus et al. | 502/521 |

FOREIGN PATENT DOCUMENTS

| | | | |
|---|---|---|---|
| 296752 | 9/1928 | United Kingdom | 208/48 AA |

*Primary Examiner*—Patrick P. Garvin
*Assistant Examiner*—George R. Fourson

[57] ABSTRACT

Contaminant metals in hydrocarbon oils such as nickel, vanadium and iron deposit on inert sorbents during pretreatment of the oils in a fluidized reactor-regenerator system, and catalyze dehydrogenation reactions contributing to excessive coke and gas make. The dehydrogenation activity of the said contaminant metals is suppressed by depositing minor amounts of a bismuth-containing passivating agent on the inert solids, desirably, at a weight ratio of bismuth to nickel equivalents (nickel+0.2 vanadium+0.1 iron) of about 0.01:1 to about 1:1. The passivating agent can consist of mixtures of compounds of bismuth and antimony, and bismuth and tin, with the weight ratio of bismuth to antimony in the range of about 0.01:1 to about 100:1, and weight ratio of bismuth to tin in the range of about 0.01:1 to about 100:1.

13 Claims, No Drawings

METHOD FOR SUPPRESSING THE DEHYDROGENATION ACTIVITY OF DEPOSITED METALS ON INERT SOLIDS IN HEAVY OIL PRETREATMENT

This is a continuation of application Ser. No. 106,485, filed Oct. 6, 1987 now abandoned.

The invention relates generally to heavy oil pretreatment, in particular to the suppression or mitigation of the dehydrogenation effect of metals such as nickel, vanadium, and iron on inert solids by deposition of controlled amounts of a passivating agent. The passivating agent consists of bismuth alone, or bismuth in combination with antimony, or bismuth in combination with tin. Desirably, the passivating agent containing bismuth is introduced into the pretreatment unit at a rate that maintains a weight ratio of passivating agent to nickel equivalents (nickel+0.2 vanadium+0.1 iron) ratio of about 0.01:1 to about 1:1 over the course of the heavy oil pretreatment.

BACKGROUND OF INVENTION

Residual fractions obtained from the distillation of poor quality crudes contain substantial amounts of metals such as Ni, V, Fe, Cu, and Na, and have a high concentration of asphaltenes, polynuclear aromatics and other coke precursors. These residual oils are rendered more suitable as feedstocks to refinery processing units, such as fluid catalytic cracking and hydrocracking, by first pretreating the residual oils, in the absence of hydrogen, in order to remove substantial portions of the metal and coke precursor contaminants. Such pretreatment processes involve contacting poor quality, high boiling residual oils with a solid sorbent particle exhibiting relatively low or no significant cracking activity, under conditions of time, temperature and pressure sufficient to reduce the metals and Conradson carbon residue values of the residual oil feed to within more acceptable limits for downstream processing such as catalytic cracking.

The literature suggests many processes for the reduction of metals and coke precursors in residual and other contaminated oils in the absence of added hydrogen. One such process is described in U.S. Pat. Nos. 4,243,514; 4,263,128; 4,311,580; 4,328,091 and 4,427,538, assigned to Engelhard Minerals and Chemicals Inc., which patents are incorporated herein by reference. Other examples are U.S. Pat. No. 4,427,539, assigned to Ashland Oil, Inc., and U.S. Pat. No. 3,983,030, assigned to Mobil Oil Corporation.

During residual oil pretreatment processes, the contaminant metals may be deposited in a relatively nonvolatile form on inert solids. These metal contaminants are generally specified as parts per million (ppm) nickel equivalents, defined as the sum of the nickel content in ppm plus one-fifth the vanadium content in ppm, plus one-tenth the iron content in ppm or (nickel +0.2 vanadium+0.1 iron). The deposition of these contaminant metals on the inert solid sorbents during the pretreatment process poses two problems. First, it has been found that as the vanadium content of the sorbent increases above 5000 ppm, the sorbent begins to have fluidization problems. More importantly, the elevated temperatures found in the regeneration zones, which are necessary for the removal of carbonaceous deposits, cause significant amounts of vanadium oxides (vanadia) to melt, flow and form a liquid coating on the sorbent particles, rendering the particles less effective for sorption, while also interrupting fluidization. This aspect of the problem, related to deposited vanadium on the inert sorbent, is taught in U.S. Pat. No. 4,469,588, which is incorporated herein by reference.

A second problem associated with the deposition of contaminant metals on inert sorbents is the dehydrogenation activity of the deposited metals. Nickel, and to a lesser extent, vanadium, iron and copper, can themselves promote undesirable dehydrogenation reactions which result in excessive production of hydrogen. This excess hydrogen will tend to overload the gas recovery system and produce excessive coke, resulting in poorer yields of liquid products, and excessively high temperatures during regeneration of the carbonaceous materials on the inert solids.

Previously, the problems caused by the deposition of contaminant metals on inert sorbents during heavy oil pretreatment have been overcome by removal of a portion of spent sorbent inventory on a continuous basis, and replacing it with fresh, metal contaminant-free sorbent.

Recently, however, inventions have been disclosed that seek to mitigate the deposited metals-induced problems via means other than, or in addition to, simply replacing a portion of the spent sorbent inventory. Solutions to the first problem, namely the vanadium-induced pore plugging of the sorbent, have been proposed in U.S. Pat. Nos. 4,469,588, 4,513,093 and 4,515,900, assigned to Ashland Oil, Inc. The inventions involve the introduction of metal additives onto the sorbent material to immobilize vanadia by forming compounds, complexes or alloys between the deposited vanadia and the additive material. These newly formed compositions have a higher melting point than the temperatures permitted to be achieved during the regeneration operation. The list of additive metals include Mg, Ca, Sr, Ba, Sc, Y, La, Ti, Zr, Hf, Nb, Ta, Mn, Tc, Re, Ni, Ru, Rh, Pd, Os, Ir, Pt, In, Tl, Bi, As, Sb, and all elements in the lanthanide and actinide series. The additives are chosen such that, based on a 1:1 mole ratio of the metal additive oxide to vanadium pentoxide, the melting points of the mixtures are greater than regeneration temperatures. No mention is made in these references of a process to mitigate the dehydrogenation effects of deposited nickel. In fact, nickel is claimed as one of the additives for immobilizing vanadia on the sorbent.

U.S. Pat. No. 4,325,809, assigned to Engelhard Minerals and Chemicals Inc., teaches the introduction of a silica donor along with the sorbent material, reacting the mixture at high temperature in the presence of steam to induce migration of silica from the donor to mask metal on the sorbent. Again, this invention does not disclose a method for passivating the dehydrogenation activity of the contaminant metals deposited on the inert sorbent.

Thus, among other factors, it is an object of the present invention, to passivate the dehydrogenation activity of deposited metals, primarily nickel, and to a lesser extent, vanadium, iron, sodium and copper, on inert, solid sorbents during non-hydrogenative pretreatment of heavy oil. This passivation comprises the deposition on said inert, solid sorbent of bismuth or compounds of bismuth.

SUMMARY OF THE INVENTION

During the course of heavy oil pretreatment over inert sorbent, with little or no cracking activity and in the absence of hydrogen, contaminant metals such as nickel, vanadium, iron, sodium and copper deposit on the inert sorbent and contribute to undesirable dehydrogenation reactions. It has now been discovered that the addition of small amounts of bismuth, or compounds of bismuth, to the inert sorbent, can passivate the contaminant metals, especially and preferably nickel, and thereby mitigate the dehydrogenation activity of the contaminant metals, and help reduce undesirable coke and hydrogen make in the pretreatment step.

DETAILED DESCRIPTION OF THE INVENTION

The process of the present invention is carried out in a system which includes a pretreatment zone and a separate solids regeneration zone. The regeneration zone is integral with the pretreatment zone, and the inert solids are circulated through it to burn off deposited carbon. In a preferred embodiment, the process is similar to and arranged sequentially with a conventional fluid catalytic cracking unit.

U.S. Pat. No 4,243,514 describes a suitable process for the pretreatment of heavy oils using a solid sorbent that has little or no cracking activity. U.S. Pat. No. 4,243,514 also includes a figure that describes a suitable apparatus for carrying out the pretreatment process. Both patents are incorporated herein by reference.

In a pretreatment operation which continues over a relatively long period of time, solids are continuously or periodically removed from the system and replaced with an equal quantity of fresh make-up solids at a sufficient rate, as determined by analytical or empirical evidence obtained from the pretreatment operation, to maintain suitable overall contaminant metals level on the solids. Without solids replacement in a continuing operation, the metals levels on the solids will continue to increase until the coke and gas make becomes excessively high at which point the operation is stopped.

Tolerance to metals, especially nickel, deposited on the solid sorbent can be increased, however, by the use of passivators which reduce or retard the detrimental effects of the metal contaminants. Using a passivating agent, which in the present invention preferably comprises bismuth and its compounds, the pretreatment process can operate continuously or for long periods of time notwithstanding a high metals content in the hydrocarbon feed. This continuous pretreatment procedure can be carried out with a relatively stabilized ratio of bismuth to nickel equivalents deposited on the solid sorbent within the specified range, this ratio being determined by the ratio of these metals introduced into the system.

A particular advantage of this process is that it enables a pretreating operation to be conducted on a hydrocarbon feed and minimize coke and hydrogen make, notwithstanding the fact that the solid sorbent has exceptionally high contents of deposited nickel equivalents—a content that can be as high as 1.0 to 5.0 percent, or higher. As a result of this substantial improvement in tolerance of the process to metals, the pretreating operation can be carried out with a significant reduction in the rate of solids replacement over the rate which would otherwise be required for nonprotected solids. This reduction in solids requirement, therefore, results in a substantial savings in sorbent costs, and a concomitant savings in overall process costs.

The claimed process is especially suitable for use with crude petroleum residua having a high nickel equivalents content. However, other heavy hydrocarbon materials containing high levels of metals, such as 50 to 100 ppm or higher, can also be economically cracked in the process.

In a preferred embodiment, bismuth is added to the system in a rate-controlled manner by adding bismuth itself or a bismuth-containing compound to the pretreatment reactor, either in the feed stream itself or in a separately introduced stream to the pretreatment reactor. It may also be introduced by injection of the bismuth or bismuth-containing compound directly into the regenerator. For convenience of handling, these compounds can be dissolved in a suitable quantity of a hydrocarbon solvent such as benzene, toluene, alcohols, glycols, mild acids such as acetic acid, a hydrocarbon fraction that is recovered from the pretreating operation, or a colloidal suspension of the metal or metal compound in any of these solvents. The bismuth solution can then be more easily metered into the system at the desired rate. Alternatively, the bismuth compound can be impregnated onto replacement solids by conventional, suitable impregnation techniques prior to the solids' use in the process.

The amount of bismuth that is used to passivate the nickel equivalents on the inert solid sorbent is determined by analyzing the feed stream for nickel, vanadium, and iron. The bismuth compound is then metered into the reactor or into the regenerator at a rate which is within the range of about 0.01:1 to about 1:1 parts by weight of bismuth per part of nickel equivalents in the feed stream. An alternative, but less preferred method of addition comprises measuring nickel equivalents on solid sorbent itself and then adjusting the bismuth on the solids to be the preferred ratio.

Any bismuth compound, containing organic groups, inorganic groups or both, which suppresses the dehydrogenation effects of the metals can be used effectively. When the bismuth compound is introduced with the feed stream into the reactor, an oil-soluble or process hydrocarbon-soluble organic compound of bismuth is generally preferred. The preferred organic groups include alkyl groups having from 1 to 12 carbon atoms, preferably 1 to 6 carbon atoms; aromatic groups having from 6 to 8 carbon atoms, preferably phenyl; and organic groups containing oxygen, sulfur, nitrogen, phosphorus or the like.

Suitable compounds of bismuth include bismuth metal, bismuth oxide, and compounds convertible to bismuth oxide under the conditions employed in the pretreatment process. Other suitable compounds include bismuth chlorides, nitrates, hydroxides, octoates, phosphates, sulfates, sulfides, selenides, molybdates, naphthenates, oxalates, titanates, triethyl, triphenyl and trivinyl bismuth.

In accordance with another embodiment of this invention, there is provided a novel treating agent which comprises mixtures of bismuth and antimony, and bismuth and tin, either as the elemental metals or as compounds thereof, as well as mixtures thereof wherein the weight ratio of bismuth to antimony, and bismuth to tin is selected so as provide passivation of contaminant metals greater than the sum of the passivation effects of each of the bismuth and antimony, or bismuth and tin individually. In general, the weight ratio of bismuth to antimony, and bismuth to tin, will be within the range of about 0.001:1 to about 1000:1, more generally, 0.01:1 to 100:1, preferably in the range of 0.05:1 to 5:1.

The following examples are presented to illustrate objects and advantages of the present invention. However, it is not intended that the invention should be limited to the specific embodiments presented therein:

A series of pretreatment runs was carried out to determine the effect of bismuth in heavy oil pretreatment using a cyclic, fluidized bed reaction-regeneration unit. Metals such as nickel and bismuth were deposited on inert solid sorbent by loading the fluidized bed with inert sorbent material, typically alumina, and passing metal(s)-doped hydrocarbon oil feed over the bed for a period of time at prescribed temperature and pressure conditions; the oil flow was then stopped, the inert bed of sorbent material was steam stripped, and the unit switched to a regeneration mode by introducing oxygen-containing gas to burn the carbon off the sorbent in the fluidized bed reactor. Following regeneration, the unit was switched back to the reaction mode by reintroducing the metal(s)-doped hydrocarbon oil. The process was repeated for up to 50 cycles of reaction, stripping and regeneration for each run, until the desired level of metal(s) on the inert solids was achieved. For depositing nickel and bismuth, nickel naphthenate and bismuth octoate were used as the respective metal compounds with which the hydrocarbon feed was doped. The hydrocarbon oil feed used in the experiments was a virgin gas oil, and had the properties shown in Table I.

TABLE I

| | |
|---|---|
| Gravity, °API | 24.0 |
| Sulfur, Wt % | 0.17 |
| Nitrogen, Wt % | 0.14 |
| Carbon Residue, Rams D 525, Wt % | 0.30 |
| Simulated GC Distillation, D 2887, °F. | |
| 10% | 626 |
| 30% | 738 |
| 50% | 803 |
| 70% | 869 |
| 90% | 977 |

Following metal deposition on the inert solids, microactivity tests were conducted on the solids using the same hydrocarbon oil (but without doped metals) as feed, to simulate the pretreatment process. All of the microactivity experiments were carried out at identical reactor conditions of 960° F. temperature and 32 weight hourly space velocity.

EXAMPLE I

In the first series of experiments, alumina with a surface area of 77 $m^2/gm$ was employed as the inert solid sorbent in the fluidized bed reactor, and feed doped with nickel was used in the cyclic reaction-regeneration unit until approximately 0.8 weight percent nickel had been deposited on the sorbent. This sorbent was then tested for activity in a microactivity unit, and the measured conversion of the hydrocarbon oil feed to 430° F. minus products, along with the measured yields of hydrogen and coke, are shown in Table II, column 1. A feed doped with nickel and bismuth was then used in the cyclic reaction-regeneration experiments to deposit simultaneously on a fresh batch of the same alumina, roughly 0.8 weight percent nickel and 0.7 weight percent bismuth. The conversion to 430° F. minus products, and hydrogen and coke yields measured with the sorbent material containing both the nickel and the bismuth in a subsequent microactivity test, are shown in column 2 of Table II. Comparing the results in columns 1 and 2 in Table II, it is clear that the presence of bismuth has lowered the amount of hydrogen and coke produced via dehydrogenation catalyzed by the nickel. Notice that the bismuth is effective even though the level of nickel on the sorbent is higher in the case where both nickel and bismuth are present as compared to the bismuth-free case.

TABLE II

PASSIVATION OF NICKEL ON ALUMINA WITH BISMUTH

Inert Sorbent: Alumina, 77 $m^2/gm$ Surface Area

| | | |
|---|---|---|
| Nickel on Alumina, Wt % | 0.77 | 0.82 |
| Bismuth on Alumina, Wt % | — | 0.68 |
| Microactivity Test Data: | | |
| Conversion to 430⁻° F., Vol % | 17.7 | 13.9 |
| Hydrogen, Wt % | 0.70 | 0.51 |
| Coke, Wt % | 7.0 | 6.3 |

EXAMPLE II

Example I was repeated in all respects except that the inert, sorbent material was an alumina with a surface area of 196 $m^2/gm$. As shown in Table III, the passivator was again effective in reducing the coke and hydrogen make associated with the dehydrogenation reactions catalyzed by nickel.

TABLE III

PASSIVATION OF NICKEL ON ALUMINA WITH BISMUTH

Inert Sorbent: Alumina, 196 $m^2/gm$ Surface Area

| | | |
|---|---|---|
| Nickel on Alumina, Wt % | 1.02 | 1.02 |
| Bismuth on Alumina, Wt % | — | 0.77 |
| Microactivity Test Data: | | |
| Conversion to 430⁻° F., Vol % | 21.1 | 19.4 |
| Hydrogen, Wt % | 0.80 | 0.65 |
| Coke, Wt % | 8.08 | 7.75 |

What is claimed is:

1. A process for the pretreatment of hydrocarbon oil feed which comprises contacting a hydrocarbon feed containing metal contaminants, including nickel, with an inert, sorbent material in a fluidized reactor zone and regenerating said sorbent in a regeneration zone, with circulation of said sorbent between the reactor zone and said regeneration zone, so that the two zones operate as an integrated system; the improvement which comprises:

introducing said sorbent into said process, wherein said sorbent contains a composition for mitigating the dehydrogenation reactions caused by the deposition of the contaminant metals on the inert sorbent material during heavy oil pretreatment, said composition comprising a bismuth compound or mixtures of bismuth compounds, in a weight ratio of introduced bismuth to nickel equivalents of between about 0.01:1 and about 1:1.

2. The process of claim 1 in which said inert, sorbent is selected from the group consisting of alumina, synthetic silica-alumina and clay, and has a microactivity for cracking of 20 or less.

3. The process of claim 1 wherein said hydrocarbon feed contains at least 1 ppm nickel equivalents.

4. The process of claim 1 wherein said circulating sorbent is removed at a rate of about 0.5 to about 25 percent of the total inventory per day and replaced with fresh, essentially non-contaminated/sorbent.

5. The process of claim 1 in which said bismuth compound is an organic compound soluble in said hydrocarbon feed or capable of forming a colloidal suspension in said hydrocarbon feed.

6. The process of claim 1 in which said composition is introduced into the regeneration zone of the pretreatment system as solids, in admixture with fresh make-up solids.

7. A process for the pretreatment of hydrocarbon oil feed which comprises contacting a hydrocarbon feed containing metal contaminates, including nickel, with an inert sorbent material in a fluidized reactor zone and regenerating said sorbent in a regeneration zone, with circulation of said sorbent between the reactor zone and said regeneration zone, so that the two zones operate as an integrated system; the improvement which comprises:

introducing into said process said sorbent and a composition for mitigating the dehydrogenation reactions caused by the deposition of the contaminant metals on the inert sorbent during said pretreatment, said composition comprising a bismuth compound or mixtures of bismuth compounds, in a weight ratio of introduced bismuth to nickel equivalents of between about 0.01:1 and about 1:1.

8. The process of claim 5 or 7 in which said composition is selected from the group consisting of bismuth compounds, mixtures of bismuth compounds, mixtures of bismuth and antimony compounds, and mixtures of bismuth and tin compounds.

9. The process of claim 7 in which said composition is introduced separately into said pretreatment system.

10. The process of claim 7 in which said composition is introduced into the pretreatment system concurrently with the hydrocarbon feed.

11. The process of claim 7 in which said composition is deposited on essentially fresh solids, and the resulting composition introduced into the pretreatment system.

12. The process of claim 7 in which said composition is admixed with regenerated solids prior to introduction thereof into the pretreatment zone.

13. The process of claim 7 in which said composition is introduced into the regeneration zone of the pretreatment system as solids, in admixture with fresh make-up solids.

* * * * *